US005425316A

United States Patent [19]

Malone

[11] Patent Number: 5,425,316

[45] Date of Patent: Jun. 20, 1995

[54] METHOD AND APPARATUS FOR CONTROLLING A WASTE DISPOSAL SYSTEM

[75] Inventor: Patrick C. Malone, The Colony, Tex.

[73] Assignee: NCE Concepts, Ltd., Carrollton, Tex.

[21] Appl. No.: 135,792

[22] Filed: Oct. 12, 1993

[51] Int. Cl.[6] ..... F23G 5/00

[52] U.S. Cl. ..... 110/190; 110/346

[58] Field of Search ..... 110/185, 190, 235, 345, 110/346

[56] References Cited

U.S. PATENT DOCUMENTS

| | | | |
|---|---|---|---|
| Re. 34,298 | 6/1993 | Gitman et al. | 431/5 |
| 4,635,572 | 1/1987 | Nickel | 110/343 |
| 4,793,268 | 12/1988 | Kukin et al. | 110/343 |
| 5,088,424 | 2/1992 | Sardari et al. | 110/344 |
| 5,261,337 | 11/1993 | Orita et al. | 110/346 |
| 5,265,544 | 11/1993 | Bigelow et al. | 110/345 |

FOREIGN PATENT DOCUMENTS

| | | | |
|---|---|---|---|
| 507060 | 10/1992 | European Pat. Off. | 110/185 |
| 189421 | 7/1989 | Japan | 110/185 |

*Primary Examiner*—Henry A. Bennet
*Assistant Examiner*—William C. Doerrler
*Attorney, Agent, or Firm*—Baker & Botts

[57] ABSTRACT

Waste disposal system (10) is provided comprising first combustion chamber (40) for incinerating waste material to produce ash and exhaust containing gases and particulate matter. Waste disposal system (10) also has includes second combustion chamber (60) for firing the exhaust containing gases and particulate matter. The waste disposal system of the present invention also includes a plurality of subsystems working in cooperation with first (40)and second (60) combustion chambers, and control system (220) to control the plurality of subsystems to ensure the desired level of incineration of the waste in the first and second combustion chambers. Control system (220) includes a plurality of sensors to measure conditions throughout waste disposal system (10), and controller (221) to continuously monitor the measured conditions and to compare each of the measured conditions to a predetermined performance range. Controller (221) is also able to determine and implement corrective action necessary to modify the performance of each subsystem so as to operate waste disposal system (10) in a predetermined performance level. Control system (10) is programmable to allow for changing the performance parameters of waste disposal system (10). Control system (220) is accessible from locations remote from the system through multiple communication mediums (390).

16 Claims, 6 Drawing Sheets

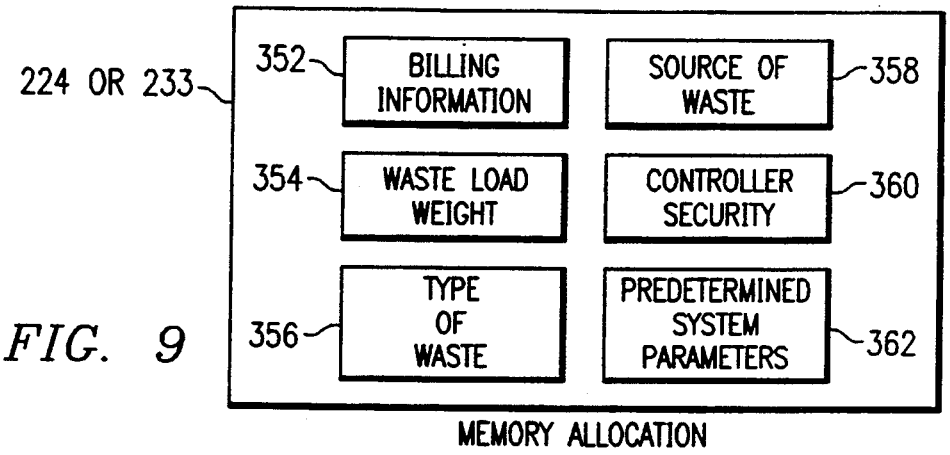
FIG. 9
FIG. 10
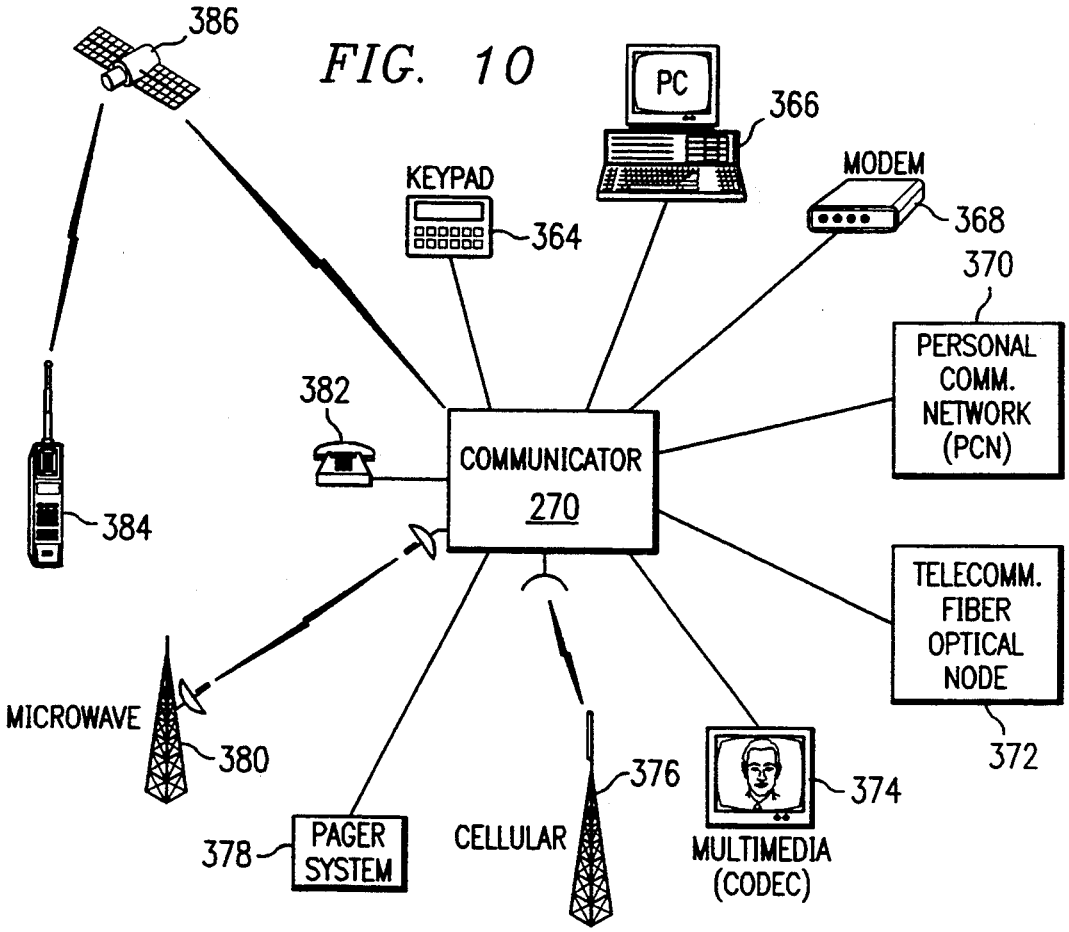
FIG. 11
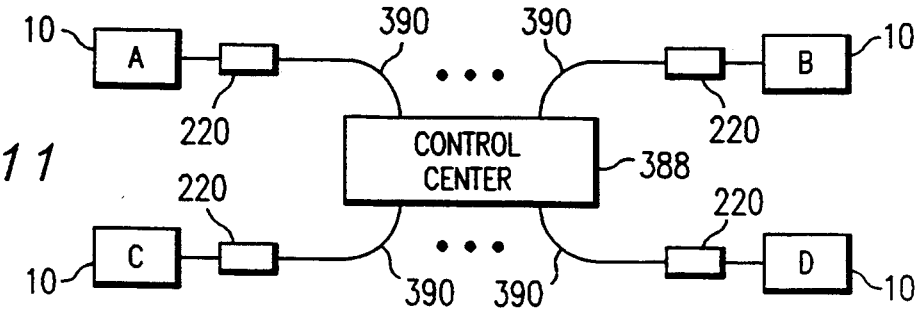

METHOD AND APPARATUS FOR CONTROLLING A WASTE DISPOSAL SYSTEM

TECHNICAL FIELD OF THE INVENTION

This invention relates in general to the field of waste disposal systems, and more particularly to an improved control system for operating a waste disposal system.

BACKGROUND OF THE INVENTION

There is an increasing concern regarding the safe disposal of trash or waste material from a variety of sources. Trash or waste material varies widely in composition and not only is it hazardous in many instances, but the by-products of the disposal system may yield material that is infectious, carcinogenic, toxic and pungent, not to mention bulky and unsightly. Incineration of waste material is an attractive alternative as compared to many other processing methods. The incineration process burns combustible materials producing various by-products. By-products include an exhaust made of combustible and non-combustible gases, ash, and non-combustible residue. In many instances, the by-products pose greater potential hazards than the original waste material.

Conventional incineration systems presently in use are basically comprised of a primary combustion module (using an oxygen starved atmosphere) and a secondary combustion module (using an oxygen rich atmosphere) sometimes known as the afterburner. An improved incinerator system that achieves a better burn with reduced emissions reverses the combustion process of a conventional system using an oxygen enriched primary and oxygen starved secondary chamber. The improved system is described in U.S. Pat. No. 5,203,267.

Conventional incineration systems have the disadvantage that they require manual control, monitoring, and maintenance. Each subsystem of present incinerator systems has a separate controller. A controller for one system has limited access to the performance characteristics of other subsystems. This leads to inefficient operation of the overall incinerator system, which in turn can result in preventing the level of incineration of the waste material required to make the waste material safe and reduce the overall efficiency of the system. Also, since each of the subsystems in presently available incinerators are individually controlled, adjusting the operating parameters for optimum performance of the entire system is not easily achieved. This is particularly troublesome when operation requirements for the incinerator systems change, e.g. low energy waste materials vs. high energy waste materials.

Currently available incinerator systems also have manual start-up and shut-down procedures, wherein each module of the subsystem must be manually actuated in order to achieve the desired start-up or shut-down of the entire system. Also, prior stand-alone subsystem incinerator systems cannot take advantage of improved control technologies as they evolve to provide faster and more powerful computing, monitoring, and feedback controls.

SUMMARY OF THE INVENTION

Therefore, a need has arisen for a waste disposal system with an integrated control system which overcomes the problems of prior incinerator systems. In accordance with the present invention, an integrated control system for a waste disposal system is provided which substantially eliminates or reduces disadvantages and problems associated with prior waste disposal systems.

A waste disposal system is provided having a first combustion chamber for incinerating waste material to produce ash and exhaust containing gases and particulate matter and a second combustion chamber for firing the exhaust containing gases and particulate matter. The waste disposal system of the present invention also includes a plurality of subsystems working in cooperation with the first and second combustion chambers, and a control system to control the subsystems to ensure the desired level of incineration of the waste in the first and second combustion chambers. The control system includes sensors to measure conditions throughout the waste disposal system, and a central controller to continuously monitor the measured conditions and to compare each of the measured conditions to a predetermined performance range. The controller is also able to determine and implement corrective action necessary to modify the performance of each subsystem so as to operate the waste disposal system at a predetermined performance level. The control system of the present invention is programmable to allow for changing the performance parameters of the waste disposal system. The control system of the present invention also may be accessed from remote locations through multiple communication mediums. An alternate embodiment of the present invention allows for linking the control system of multiple disposal systems into a control center. The control center can then be used for modifying and monitoring the separate disposal systems in a more efficient manner. Moreover, in another embodiment of the present invention, a control center can be used to monitor and control multiple waste disposal systems at remote locations, thereby allowing for either local or remote control of each waste disposal system.

The integrated control structure of the present invention also provides a technical advantage of providing continuous monitoring and control of all subsystems and modules within the waste disposal system, leading to more efficient operation of the waste disposal system. Integrated control and feedback prevents the squandering of fuel and provides for more complete burning of the waste. More complete burning of the waste provides a technical advantage of cleaner emissions from the waste disposal system. Since the control system of the present invention is responsive to conditions in the waste disposal system, it provides a technical advantage of allowing the waste disposal system to incinerate multiple forms of waste, i.e. from low energy to high energy waste products. The control system of the present invention also provides a technical advantage of automated start-up and shut-down. Also, since the integrated control system of the present invention continuously monitors the performance of the waste disposal system, it can sense and/or prevent a condition that might lead to damage of the waste disposal system.

The integrated control system of the present invention provides a technical advantage of shared data collection and storage among the subsystems. This allows for more thorough analysis and report generation capabilities on the performance of the waste disposal system. The control system of the present invention allows for a technical advantage of coordinated execution of all processes in the waste disposal system. It can provide real-time analysis of the performance of the waste disposal system so that its operation can be modified continuously to obtain the operation of the waste disposal system at or near maximum efficiency. Also, as the requirements of the system are changed, the performance levels of the system can be modified with the control system of the present invention. This provides a technical advantage of a programmable waste disposal system and does not, for example, limit the waste disposal system to a certain type of waste or to specified emission level.

The present invention also provides a technical advantage of being easily expandable and upgradeable as computer and communication technologies evolve. Since the control system of the present invention uses currently available sensing and processing equipment, its costs are maintained low.

The control system of the present invention provides a technical advantage of being accessible through all communication mediums. Therefore, the control system of the present invention can be linked to a central control center controlling numerous waste control systems, thereby providing the technical advantage of allowing monitoring and modifications to numerous systems from a single central control location.

BRIEF DESCRIPTION OF THE DRAWINGS

For a more complete understanding of the present invention and the objects and advantages thereof, reference is now made to the following description taken in connection with the accompanying drawings in which:

FIG. 9 depicts a possible memory allocation scheme for the memory of the control system of the present invention;

FIG. 10 depicts the various possible mediums through which the control system of the present invention may be accessed; and FIG. 11 depicts a block diagram for the central control center with the control system of the present invention.

DETAILED DESCRIPTION OF THE INVENTION

The embodiments of the present invention are illustrated in the Figures, like numerals being used to refer to like and corresponding parts of the various drawings.

Figure 1:
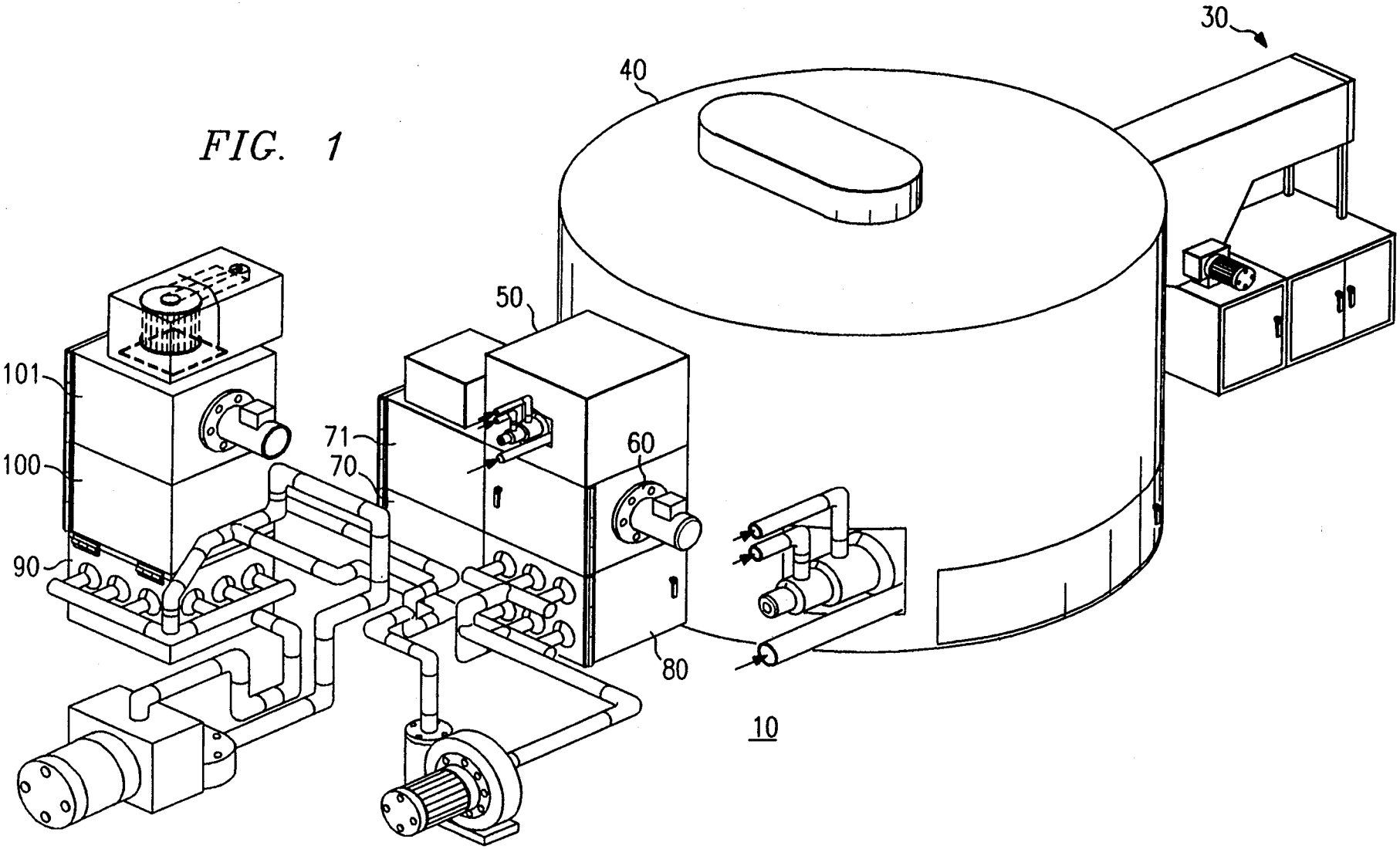
FIG. 1 shows a waste disposal system.

In FIG. 1 is an exemplary waste disposal system 10 for which the control system of the present invention can be used. Waste disposal system 10 is more thoroughly described in U.S. Pat. No. 5,203,267 (Application Ser. No. 804,474) entitled "Method and Apparatus for Disposing of Waste Material," issued Apr. 20, 1993. A short description of the operation of waste disposal apparatus 10 will be included to help explain the control system of the present invention. Waste disposal apparatus 10 includes loading module 30 for loading waste material into waste disposal system 10. Loading module 30 processes the waste material by reducing it in size, shredding it, and feeding the processed waste material to first combustion chamber 40 for incineration. The waste material is incinerated in first combustion chamber 40 in an oxygen-rich atmosphere, and the waste is reduced to ash and exhaust. The exhaust produced in first combustion chamber 40 is directed to second combustion chamber 50, where the exhaust is fired in an oxygen-starved atmosphere.

Continuing with FIG. 1, the fired exhaust is cooled in air-cooling module 60 before entering electrostatic module 71. Particles contained in the fired exhaust are removed by electrostatic module 71 before the fired exhaust enters reducing catalyst module 70, where selected by-products of combustion are chemically reduced. From reducing catalyst module 70, the fired exhaust is directed to oxidizing catalyst module 80 where carbon monoxide is converted to carbon dioxide. After leaving oxidizing catalyst 80, the fired exhaust enters the liquid filter contained in liquid filtering module 90 to remove any additional particulate matter contained in the fired exhaust and to treat the fired exhaust chemically. After passing through liquid filtering module 90, the fired exhaust enters neutralizing module 100 and cooling module 101 before being introduced into the atmosphere by employment of an induced draft fan.

Figure 2:
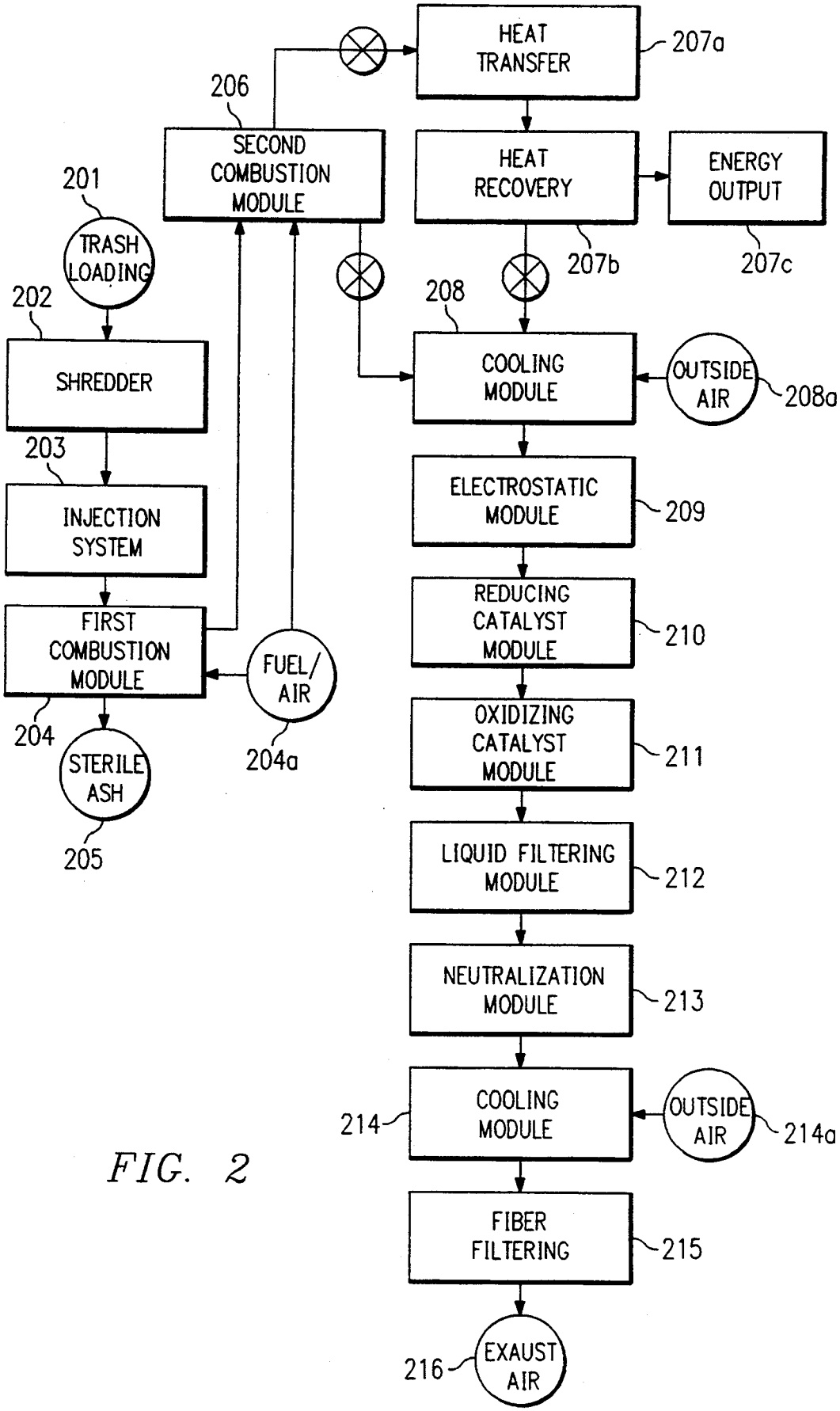
FIG. 2 is a flowchart showing the various steps for performing waste disposal in accordance with the system of FIG. 1.

Referring to FIG. 2, a method for disposing waste employing waste disposal apparatus 10 will be explained. In the first step 201, trash or waste material is loaded into the system. In the second step 202, the loaded waste material is shredded to reduce its size and weight before passing the waste material to the first combustion module 204. The shredded materials are conveyed by injection system 203 from shredder 202 to first combustion module 204 where it is mixed with fuel air for incineration in fuel/air mixing step 204a. As a result of the incineration step in first combustion module 204, the waste material is converted to inert sterile ash and exhaust. The sterile ash is removed from first combustion module 204 in step 205. Injection system 203 not only works to provide waste and air to first combustion chamber 30, but also can be used to regulate the temperature in loader 30. By appropriately modulating the air flow with injection system 203, heat build up from combustion chamber 40 can be prevented.

Exhaust from combustion module 204 is passed to second combustion module 206 where the exhaust is mixed with fuel and air and incinerated or fired to produce a fired exhaust. In steps **207*a* through 207*c*, excess energy is recovered for complimentary purposes, such as to produce steam, by transferring heat (207*a*) from second combustion module 206, and then recovering the heat (207*b*) to produce a usable energy output (207*c***).

In cooling step 208, the fired exhaust is mixed with outside air **208*a*** to reduce the temperature of the fired exhaust before further processing. After cooling step 208, the fired exhaust passes through electrostatic filtering module 209 for removing particles. From electrostatic filtering step 209, the fired exhaust passes to reducing catalyst module 210 for removing oxides of nitrogen. After passing through reducing catalyst module 210, the fired exhaust passes to oxidizing catalyst module 211 for converting carbon monoxide to carbon dioxide. From oxidizing catalyst 211, fired exhaust passes to liquid filtering module 212 for liquid filtering. In the liquid filtering step 212, particles contained in fired exhaust are removed and the exhaust is chemically treated to further reduce carbon monoxide, nitrogen monoxide, sulfur monoxide and hydrogen chloride. From the liquid filtering step 212, the fired exhaust passes to the neutralization module 213 where acid gases contained in the fired exhaust are neutralized. In the next step, cooling module 214, the fired exhaust is further cooled before passing to filtering step 215, and then finally vents into the atmosphere in step 216.

Figure 3:
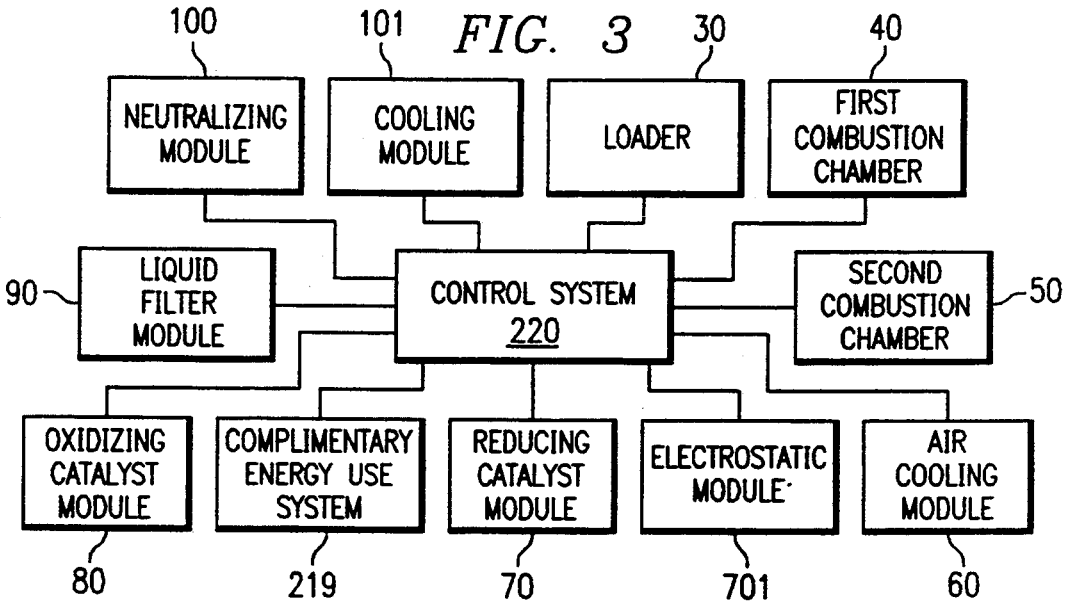
FIG. 3 depicts a top-level block diagram of the control system of the present invention.

Referring to FIG. 3 is depicted control system 220 of the present invention shown in its relationship to the subsystems of waste disposal system 10. As can be seen in FIG. 3, control system 220 can be connected to all of the subsystems of waste disposal system 10 of FIG. 1. Additionally, control system 220 may be connected to external systems such as, by way of example, complimentary energy use system 219. Control system 220 can work in cooperation with complimentary energy use system 219 to ensure that the energy needs of complimentary energy use system 219 are met. It is reminded that FIG. 3 is only exemplary of the connections of control system 220, and can be modified as the waste disposal system itself is modified.

Figure 4:
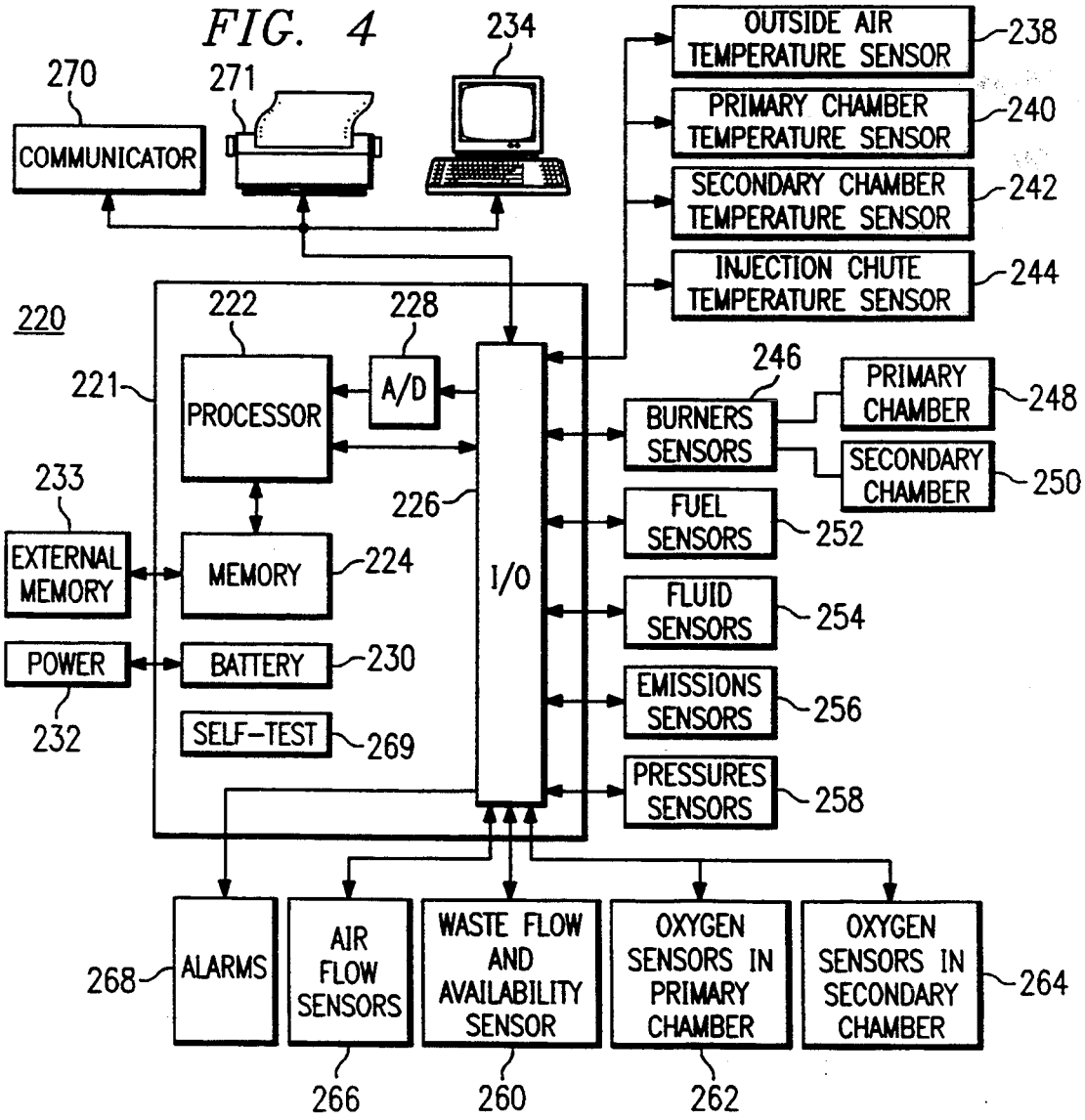
FIG. 4 depicts typical interfaces of the control system of the present invention.

In FIG. 4, is shown an embodiment of control system 220. Within control system 220 is controller 221 containing processor 222 for processing data and executing instructions. Processor 222 is connected to memory 224 wherein data and instructions for processor 222 may be stored. Controller 221 may also contain input/output (I/O) 226 which is used to connect controller 221 to the various sensor subsystems of waste disposal system 10. Also included in controller 221, between processor 222 and I/O 226, is analog-to-digital (A/D) converter 228 which can be used to convert analog data signals input to controller 221 into digital format so that the data can be processed by processor 222.

Controller 221 may also include battery backup 230 allowing for operation and data retention by controller 221 when external power is disconnected or unavailable. Controller 221 is connected to power source 232, which can be any standard power source. Control system 220, as well as waste disposal system 10, can be modified as required to work with all power sources that are available throughout the world. Power conversion techniques are well known in the art and will not be discussed herein. Also available is external memory 233. External memory 233 can be embodied in a floppy disk drive, hard disk drive, CD ROM system, optical disk drive system or any other suitable medium of storage.

Shown connected to controller 221 of control system 220 through I/O 226 are numerous sensors and other peripheral devices. Again, these sensors and devices are only provided by way of examples of the numerous sensors and devices capable of use with control system 220.

Beginning at the top is shown computer system 234. It is envisioned that in some embodiments, controller 221 will be resident in computer 234, but controller 221 can also be separate from computer 234. Computer 234 can be a personal computer, workstation, mainframe or any other appropriate computing devise or system.

Connected to controller 221 can be multiple temperature sensors, including outside air temperature sensor 238, primary chamber sensor 240, secondary chamber sensor 242 and injunction chute temperature sensor 244. The temperature sensors of control system 220 are not limited to those depicted in FIG. 4, but can be made to include sensors for any part of waste disposal system 10 for measuring and monitoring the temperature in a subsystem. Typically, the temperature sensors will provide measurements in analog format requiring conversion to digital format by A/D converter 228 for processing by processor 222.

Shown in FIG. 4 are burner sensors 246, including primary chamber burner sensor 248 and secondary burner chamber sensor 250. Burner sensors 246 can be used to monitor the operation of the burners located in the primary chamber 40 and secondary chamber 50. Closely related to the burner sensors are fuel sensors 252. Fuel sensors 252 can provide information to controller 221 on whether fuel is being provided to the burners. Should the fuel supply be interrupted to the burners, fuel sensors 252 will provide an appropriate signal to controller 221.

Connected to controller 221 is shown fluid sensors 254. Fluid sensors 254 can be used to monitor and measure fluid pressures and valve openings throughout waste disposal system 10. Suitable fluid sensors would be in-line flow meters or valve positioning monitors, but any sensor suitable for monitoring the flow and quantity of a fluid is suitable for fluid sensor 254.

Emission sensors 256 are coupled to controller 221 and may be used to monitor and measure the particle, gas, contamination level of different gases, and particles in any air which it discharged from waste control system 10. For example, an emission sensor 256 located at exhaust air step 216 of FIG. 2 may be utilized to monitor the exhaust discharged from waste control system 10. Should emission sensor 256 detect a level of emissions in exhaust air step 216 that is unacceptable to the system performance parameters, emission sensor 256 can be used in conjunction with control system 220 to either modify the performance of waste disposal system 10 to bring the predetermined emissions from waste disposal system within the desired performance level, or in the alternative, to shut down system 10. In either scenario, control system 220 can send an alarm signal to the system operator alerting the operator to the unacceptable performance of waste disposal system 10.

Also shown coupled to controller 221 are pressure sensors 258. Pressure sensors 258 can be located throughout waste disposal system 10 for sensing air and fluid pressures in the system. The pressure at which certain operations within waste control system 10 take place may be critical. For example, the pressure at which the waste material is burned in primary combustion chamber 40 may be critical to proper incineration of the waste material. A pressure sensor 258 located proximal to first combustion chamber 40 can be used to monitor the pressure in first combustion chamber 40.

Waste flow and availability sensor 260 provides information to controller 221 on the flow of waste in loader 30, and whether additional waste is available. By monitoring waste flow, controller 221 is programmed to maintain the fuel rate to either combustion chamber at its current level. Also shown in FIG. 4 are oxygen sensors for first combustion chamber 40 and second combustion chamber 50 as references 262 and 264, respectively. Oxygen content is important to the proper operation of waste disposal system 10. As explained in U.S. Pat. No. 5,203,267, the atmosphere in first combustion chamber 40 is characterized as an oxygen rich atmosphere and that in second combustion chamber 50 is characterized as an oxygen starved atmosphere. Therefore, oxygen sensors 262 and 264 are desirable to measure the oxygen content in the two chambers so that proper incineration of the waste material may be achieved. Closely related to the oxygen content in the chambers is the air flow in the chambers. Air flow sensor 266 may be used to monitor the flow of air in both the loader 30 and in the first and second combustion chambers 40 and 50, respectively. Also, within waste disposal system 10, there may be multiple air flows and additional air flow sensors 266 can be used to monitor those air flows.

It is noted that any of the sensors shown in FIG. 4 can be co-located in waste disposal system 10. For example, first combustion chamber 40 could include temperature, air pressure, oxygen, and air flow sensors. Various combinations of sensors throughout the subsystems of waste disposal system 10 are desirable for measuring the conditions in the subsystems.

Also depicted in FIG. 4 connected to controller 221 are alarms 268. Should a damaging condition be sensed anywhere in waste disposal system 10, control system 220 can sense that damaging situation by monitoring the inputs from the various sensors, and provide an appropriate alarm. Alarms 268 could be embodied in flashing lights, audible tones, radio signals to pagers, and even a mandatory shut-down of waste disposal system 10. Control system 220 can also include a self-test feature 269. In FIG. 4, self-test 269 is shown embedded in controller 221. Self-test 269 can be used to ensure that control system 220 is operating properly and to perform diagnostics on control system 220 should a fault occur.

Control system 220 of the present invention may also include access to controller 221 through communicator 270. Additional detail on communicator 270 may be found in the description relating to FIG. 10 below. Also shown attached to controller 221 is printer/plotter 271. Control system 220 has report generating capability. Reports can be displayed, for example, on the display of computer 234 or can be printed out in hard copy on printer/plotter 271. It should be noted that while controller 221 is shown in FIG. 4 as comprising separate parts, e.g. processor, A/D, memory, etc., the functions of these parts could be integrated into a single integrated circuit without affecting the inventive concepts of the present invention.

Control system 220 depicted in FIGS. 3 and 4 is an integration of hardware and software that forms a specific process and control system that provides for performing specific functions at quantifiable performance levels in the operation of waste disposal system 10. The data acquisition and control system implemented by control system 220 defines all parameters for the data acquisition methods, process control, control procedures, monitoring, and reporting as they apply to the disposal of waste material with waste disposal system 10. Data collection may involve sampling one or more sensor inputs repetitively, or one sample at a time for each sensor input upon automatic or manual command. Data is entered at a predetermined rate (clock rate) and converted to a fundamental measurement unit. In operation of the control system 220, data may be commonly shared by other processing functions, i.e., control, display, ratios, alarming, switching, etc.

Control system 220 has predetermined operating performance parameters stored in memory 224 for such items as flame train, air flow, filtering, start-up, shutdown, and any other characteristic which may be deemed important in the operation of waste disposal system 10. Based on waste disposal system 10 requirements and operating parameters, if the system's performance falls within the predetermined performance parameters, then control system 220 merely continues monitoring waste disposal system 10 by performing its normal processing, data collection, and reporting functions, If the operating performance of waste disposal system 10 is not within the predetermined performance parameters, then control system 220 can either shutdown waste disposal system 10, or alternatively, if the operating parameter drift is not deemed to-be harmful, determine and implement the necessary corrective action. Upon detecting an operating performance level of waste disposal system 10 outside of the predetermined performance parameters, control system can also generate and send an alarm signal to the system operator.

An attractive feature of control system 220 is that the predetermined performance requirements can be altered to comply with new performance specifications. Therefore, as the content of the waste being disposed in waste disposal system 10 changes, or the allowable emissions from waste disposal system 10 may change, the performance of waste disposal system 10 can be altered with control system 220. By way of example, should a high energy waste be inserted into waste disposal system 10, then control system 220 through its sensors will sense the higher temperature in either combustion chamber and accordingly decrease the amount of either fuel or waste supplied to the chamber burners.

Processor 222 of controller 221 can have many embodiments. A single processor that performs multiple tasks concurrently or multiple processors with division of tasks are possible embodiments. It is envisioned that controller 221 can be implemented with fuzzy logic which can learn when a pattern of changed operating conditions occurs in waste disposal system 10. Such a controller can then modify the acceptable performance level of waste disposal system 10 without requiring external input to control system 220. Alternatively, controller 221 with fuzzy logic could be programmed to require a prompt to and authorization from the system operator before any change to predetermined performance levels are implemented.

To provide further explanation of how control system 220 operates to achieve satisfactory performance of waste disposal system 10, various key operations implemented by control system 220 in waste disposal system 10 are described in more detail herein. These descriptions are only exemplary of the type of control practiced by control system 220 on waste disposal system 10, and are not intended to limit the functionality of control system 220.

Figure 5:
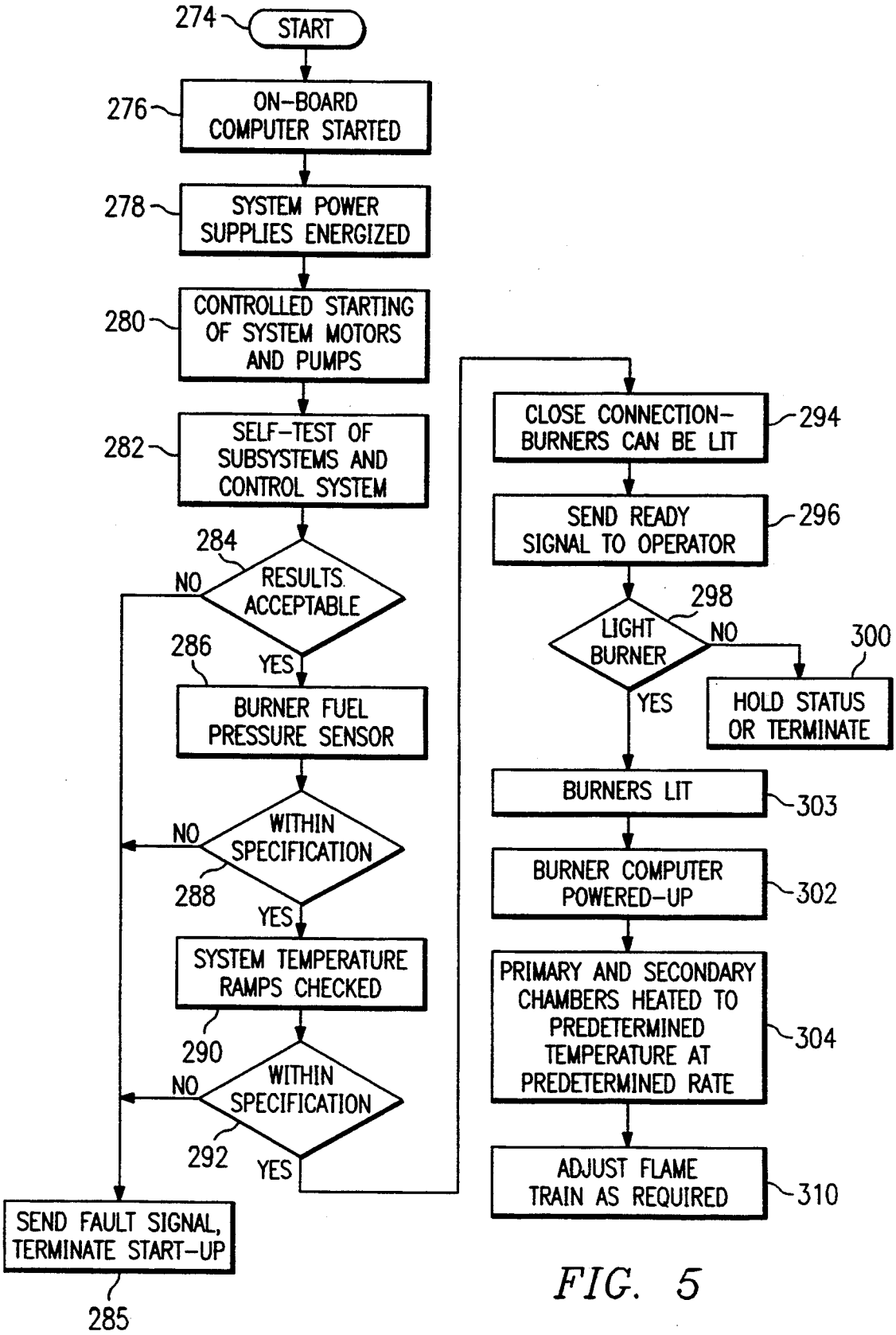
FIG. 5 depicts a flowchart showing system start-up of the waste disposal system in FIG. 1 as executed by the control system of the present invention.

An exemplary operation executed by control system 220 of waste disposal system 10 is system start-up. Shown in FIG. 5 is a flowchart showing a series of steps for waste disposal system 10 start-up. Beginning at step 274, the system start-up is initiated manually by the system operator or automatically by control system 220 itself. Shown at step 276, the on-board computer or system controller 220 is engaged if not already running.

At step 278, the power supplies of waste disposal system 10 are energized.

Next, at step 280, system 10 motors and pumps are started in a controlled manner. The starting of the motors and pumps is scheduled so that they are not all energized at one time leading to a current drain on waste disposal system 10. At step 282, control system 220 initiates a self-test of all the subsystems in waste disposal system 10. This includes, for example, determining whether the motors and pumps of system 10 are operating properly and checking the electrical/electronic systems in system 10 and control system 220. At step 284, the results of the self-test are analyzed by control system 220 and if the subsystems of waste disposal system 10 and control 220 are found to be non-functional, the start-up procedure is terminated and a fault is sent to the system operator at step 285. If the self-test indicates proper operation of the subsystems of waste disposal system 10 and control system 220, then the flow proceeds to step 286. At step 286, control system 220 checks fuel sensors 252 to ensure the burner fuel pressure is within specification at steps 286 and 288. At step 288, if the burner fuel pressure is out of specification, then the system start-up is terminated and a fault signal is again sent at step 285.

Once the fuel pressure in the burner is confirmed to be within specification, the system's temperature ramps are checked at step 290. The temperature ramps control the heating in the combustion chambers preventing the chambers from being brought to incineration temperature too quickly, as a temperature shock in the chambers may damage them. If the temperature ramps are unsatisfactory, then the start-up is terminated and a fault message is sent at step 285. If the temperature ramps are found to be satisfactory at step 292, then a connection is closed at step 294 so that the burners within the combustion chambers can be lit.

At step 296, a message is sent to the system operator that the burners are ready to be lit. At step 298, the system administrator decides whether the burners should be lit, and if he chooses not to at this point, the system goes into hold status at step 300, or alternatively, the system start-up can be terminated by the operator. It is envisioned that in a fully automated control embodiment, step 296 would be eliminated with control system 220 determining whether to light the burners. If the operator chooses to light the burners, the burner computer is started at step 302 and at step 303 the burners are lit. At step 304, the primary and secondary chambers are heated to a predetermined temperature at a predetermined rate (temperature ramps) by the burners. Once the predetermined temperatures in the chambers are reached, the chambers may be supplied waste to be incinerated. At step 310, control system 220 adjusts the flame train of the burner as required.

Figure 6:
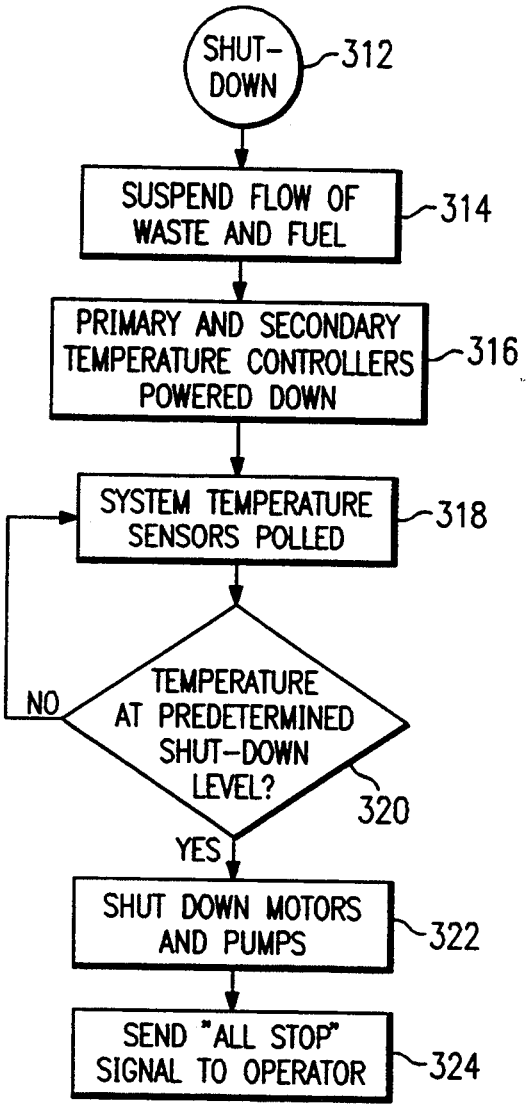
FIG. 6 depicts a flowchart for system shut-down of the waste disposal system of FIG. 1 as executed by the control system of the present invention.

FIG. 6 shows another example of an operation executed by control system 220 to shut-down waste disposal system 10. At step 312 the shut-down procedure is initiated when a signal is generated either by control system 220 in response to a predetermined set of conditions or by the operator depressing a shut-down button. Control system 220 can initiate an automatic shut-down of waste disposal system 10 when it detects a shut-down condition any where in waste disposal system 10. Examples of a shut-down conditions would be the presence of undesirable levels of explosive gasses or a temperature exceeding the rated level of a subsystem of waste disposal system 10. At step 314, the flow of waste and fuel is suspended. Typically, the flow of waste is suspended first before fuel to the burners is terminated allowing for the incineration of waste in the chamber. A simultaneous suspension of fuel and waste can be effectuated when required. The primary and secondary temperature controllers in first combustion chamber 40 and second combustion chamber 50 respectfully are powered down in step 316. At step 318, the system's temperature sensors are polled. At step 320, queries are made as to whether the temperature in chambers 40 and 50 are at the predetermined shut-down level. If they are not, then the temperature is continually polled at step 318. Once the chamber temperatures are cool enough, then the motors and pumps are shut down at step 322. Finally, at step 324, an "all clear" or all stop signal is sent to the operator, indicating that waste disposal system 10 has been successfully shut down.

Figure 7:
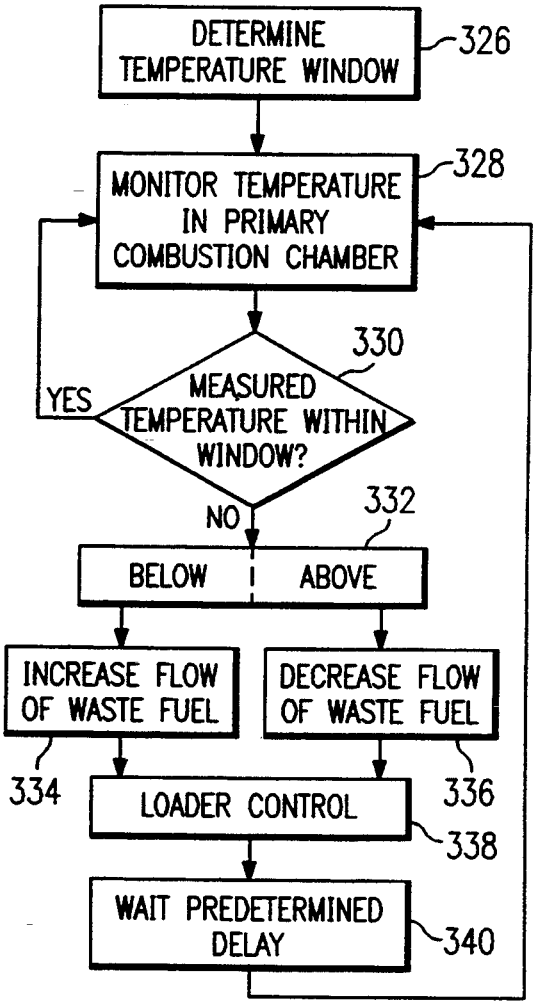
FIG. 7 is a flowchart showing the various steps for performing fuel input control for the waste disposal system of FIG. 1 as executed by the control system of the present invention.

Depicted in FIG. 7 is a flowchart of a possible example of the steps executed by control system 220 to control the amount of fuel supplied to primary combustion chamber 40 of waste disposal system 10. As a precursor to monitoring and controlling the fuel input to primary combustion chamber 40, a predetermined temperature window for combustion chamber 40 must be established at step 326 and input into control system 220. At step 328, primary chamber temperature sensor 240 monitors the temperature in primary combustion chamber 40 and provides that information to control system 220. The query is made as to whether the measured temperature is within the predetermined temperature window at step 330. If it is, then no immediate action is required, but a signal is sent by control system 220 to the sensor to continue monitoring the temperature in the combustion chamber at a predetermined poll rate.

Also at step 330, if the measured temperature is not within the window, then control system 220 must take some corrective action. At step 332, it is discerned whether the measured temperature is below or above the predetermined temperature window. If the measured temperature is below predetermined window, then at step 334, the flow of waste fuel into combustion chamber 40 is increased. This is accomplished by increasing the rates of waste shredding and air injection by loader 30 at step 338. If the measured temperature is above the window, then at step 336, control system 220 decreases the flow of waste fuel to combustion chamber 40 by decreasing waste shredding and air injection rates by loader 30 in step 338. Once a modification is made to loader 30 rates at step 338, a predetermined period of time is allowed to pass at step 340 before the temperature is once again measured in combustion chamber 40.

It is noted that control system 220 can balance the waste feed rate against the temperature in combustion chamber 40 and the air injection rate of waste into combustion chamber 40. By properly balancing the waste feed rate against the temperature in chamber 40 and air injection rate, the formation of undesirable gases, such as dioxius/furans, can be virtually eliminated. The proper control of feed rate, chamber temperature, and injection rate prevents the development of so-called "cold zones" in the waste being incinerated.

Figure 8:
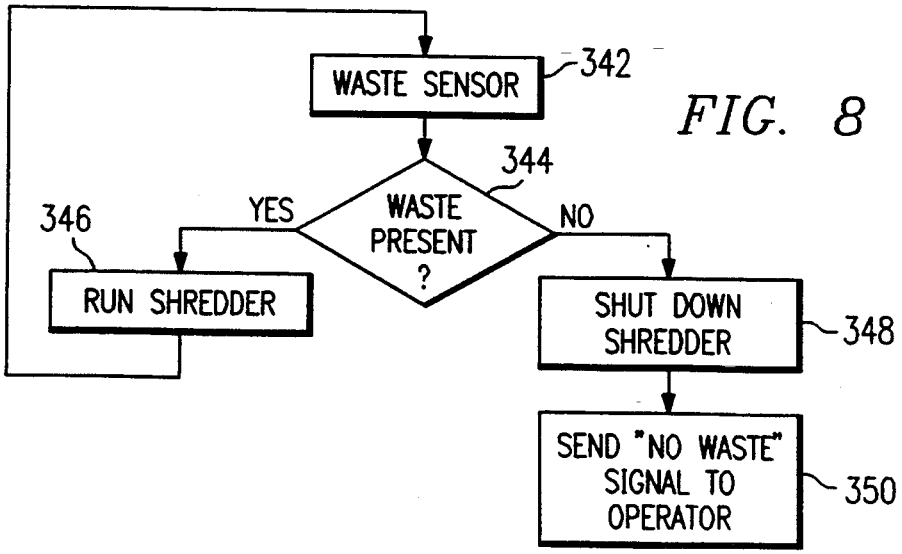
FIG. 8 is a flowchart showing the various steps for performing waste flow control in the waste disposal system of FIG. 1 as executed by the control system of the present invention.

Depicted in FIG. 8 is a flowchart for waste flow control in waste disposal system 10. At step 342, waste flow and availability sensor 260 measures whether waste is present in the waste chute. If waste is present, then at step 346, control system 220 controls the shredder of loader 30 to shred the waste. If no waste is present at step 344, then control system 220 shuts down the shredder of loader 30 at step 348. Also, upon the failure to detect waste in the waste chute at step 344, a "no waste" signal is sent to the operator at step 350. The control of FIG. 8 is intended to prevent the unnecessary burning of fuel in combustion chamber 40 when no waste is present to be incinerated allowing system 10 to go to an idle condition until waste is detected.

It is noted that the flowcharts of FIGS. 5–8 are only provided as possible examples of the types of processes control system 220 can monitor and execute in waste disposal system 10.

Depicted in FIG. 9 is shown an example of memory allocation of memory 224 and 233 of FIG. 4. The memory of control system 220 can be used to store various kinds of information, including, for example, billing information 352, waste load weight information 354, type of waste information 356, source of waste information 358, control system security 360, and predetermined system parameters 362. Control system 220 can provide for sensing the start of any test or standard burn cycle and to record automatically, on as many channels as required, analog and digital information into memory 224 or 233. The control system 220 can allow for a complete review of any channel of collected data during or after a test or standard burn cycle, and can output data on various graphic screen displays or any hard copy device such as printer/plotter 271. Additionally, the data may be transmitted to any number of on-site data collection points or remote data collection points.

Shown in FIG. 10 is an expanded view of communicator 270. Access to control system 220 and all of its capabilities can be made on many communication mediums within a communication network. Remote communication access can be accomplished via any of the mediums depicted in FIG. 10. FIG. 10 depicts key pad 364, personal computer 366, modem 368, personal communication network 370, telecommunications fiber optical node 372, multi-media (Codec) 374, cellular transmission 376, pager system 378, microwave transmission 380, standard telephone system 382, and radio or radio telephone system 384 through satellite 386. The mediums depicted in FIG. 10 are provided as examples only and are not intended to limit the communication links possible to control system 220.

Depicted in FIG. 11 is an embodiment where control system 220 of multiple waste disposal system 10 sites are coupled to control center 388. Each waste disposal system 10 may be connected to control center 388 by transmission medium 390. Connection to each waste disposal system 10 is by communicator 270 of control system 220. Communication medium 390 can be any of the medians depicted in FIG. 10, and central control center 388 can accommodate inputs on different medium types 390. Therefore, the transmission medium 390 from waste disposal system A could be a cellular connection, where that provided to waste disposal system B is radio-telephone. In an alternate embodiment, control center 388 can be used to control the individual waste disposal systems 10 to either replace the control systems at each remote site or to work with the control systems at each remote site.

Control center 388 may use many forms of communication to monitor and control all processing parameters at each site. Parameter adjustments and emergency shut-down procedures can be initiated on site or from control center 388. Control center system 388 can effectuate changes at each remote site to the predetermined performance ranges of each subsystem of each waste disposal system 10 and to the predetermined performance level of each waste disposal system 10. At control center 388, it is possible to monitor on-screen, the actual processing for several disperse waste disposal systems 10.

Therefore, control system 220 in its various embodiments provides integrated control, monitoring, and updating capabilities for a complex waste disposal incinerator system. Control system 220 of the present invention also provides for easy access and communication over all known communication mediums. The control system of the present invention can also be used to connect multiple waste disposal systems into a control center which can monitor and control the waste disposal systems at their remote locations.

Although the present invention has been described in detail, it should be understood that various changes, substitutions and alterations can be made hereto without departing from the spirit and scope of the invention as defined by the appended claims.

What is claimed is:

1. A control system for controlling a solid waste disposal system having a plurality of subsystems, the control system comprising:

a plurality of sensors operable to measure conditions throughout the solid waste disposal system;

a controller operable to continuously monitor the measured conditions and to compare one or more of the measured conditions to a predetermined performance range for each condition and to automatically determine and implement action modifying the performance of each of one or more of the subsystems so as to operate the solid waste disposal system at a predetermined performance level;

a memory operable to store a plurality of predetermined performance ranges for the conditions and the measured conditions;

wherein said controller is further operable to generate a report on the performance of the solid waste disposal system for a period of time from the stored measured conditions and can recognize a pattern of changed conditions in the solid waste disposal system and automatically modify the predetermined performance level of the solid waste disposal system by automatically modifying the predetermined performance range of each of one or more of the subsystems; and alarm circuitry responsive to the measured conditions in the solid waste disposal system and operable to provide an alarm signal when said controller determines that an alarm condition exists.

2. The control system of claim 1, wherein said controller is a programmable controller such that the predetermined performance range for each condition and the predetermined performance level of the solid waste disposal system can be modified.

3. The control system of claim 1, further comprising a communicator operable to provide a communication link to the control system through one of a plurality of communication mediums.

4. The control system of claim 1, wherein said controller is further operable to control one of an automatic start-up and shut-down of the solid waste disposal system in response to a command.

5. The control system of claim 1, wherein said controller is further operable to cause and control an automatic shut-down of the solid waste disposal system in response to one of said plurality of sensors detecting a predetermined shut-down condition in the solid waste disposal system.

6. The control system of claim 1, further comprising diagnostic circuitry operable to perform diagnostics on one of the control system and the subsystems.

7. A solid waste disposal system, comprising:

a combustion chamber for incinerating solid waste material;

a plurality of subsystems associated with said combustion chamber; and a control system comprising, a plurality of sensors operable to measure conditions throughout the solid waste disposal system, a controller operable to continuously monitor the measured conditions and to compare one or more of the measured conditions to a predetermined performance range for each condition and to automatically determine and implement action modifying the performance of one of said combustion chamber and each of one or more of said subsystems so as to operate the solid waste disposal system at a predetermined performance level, a memory operable to store a plurality of predetermined performance ranges for the conditions, and the measured conditions, wherein said controller is further operable to generate a report on the performance of the solid waste disposal system for a period of time from the stored measured conditions, and can recognize a pattern of changed conditions in the solid waste disposal system and modify the predetermined performance level of the solid waste disposal system by automatically modifying the predetermined performance range of one of said combustion chamber and said subsystems; and alarm circuitry responsive to the measured conditions in the solid waste disposal system and operable to provide an alarm signal when said controller determines that an alarm condition exists.

8. The solid waste disposal system of claim 7, wherein said plurality of sensors further comprises at least one temperature sensor in said combustion chamber operable to measure the temperature in said combustion chamber, and wherein said control system is further operable to control flow of waste to said combustion chamber in response to the temperature in said combustion chamber.

9. The solid waste disposal system of claim 7, further comprising:

a heat recovery apparatus operable to recover and transmit energy from the solid waste disposal system to a complimentary energy use system; and wherein said control system is further operable to monitor and control said heat recovery apparatus.

10. The solid waste disposal system of claim 7, wherein said control system further comprises diagnostic circuitry operable to perform diagnostics on one of said control system and said subsystems.

11. The solid waste disposal system of claim 7, wherein said controller is a programmable controller such that the predetermined performance range for each condition and the predetermined performance level of the solid waste disposal system can be modified.

12. The solid waste disposal system of claim 7, wherein said control system further comprises a communicator operable to provide a communication link to the control system through one of a plurality of communication mediums.

13. The solid waste disposal system of claim 7, wherein said control system is further operable to cause and control one of an automatic shut-down and start-up of the solid waste disposal system in response to a command.

14. The solid waste disposal system of claim 7, wherein said control system is further operable to control the performance of said combustion chamber and each of one or more of said subsystems so as to prevent the formation of undesirable gases in the system.

15. A system for controlling a plurality of solid waste disposal systems located at remote locations, the system comprising:

a plurality of solid waste disposal systems each comprising, a combustion chamber for incinerating solid waste material, a plurality of subsystems associated with said combustion chamber, and a control system comprising, a plurality of sensors operable to measure conditions throughout the solid waste disposal system, a controller operable to continuously monitor the measured conditions and to compare one or more of the measured conditions to a predetermined performance range for each condition and to automatically determine and implement action modifying the performance of one of said combustion chamber and each of one or more of said subsystems so as to operate the solid waste disposal system at a predetermined performance level, a memory operable to store a plurality of predetermined performance ranges for the conditions and the measured conditions, wherein said controller is further operable to generate a report on the performance of the solid waste disposal system for a period of time from the stored measured conditions, alarm circuitry responsive to the measured conditions in the solid waste disposal system and operable to provide an alarm signal when said controller determines that an alarm condition exists, and a communicator operable to provide a communication link to the controller;

a communication network linking each of the solid waste disposal systems through the communicator associated with each of said solid waste disposal systems;

a control center connected to said communication network and comprising communication circuitry operable to couple said control center to said control system associated with each of said plurality of solid waste disposal systems, said control center operable to continuously monitor and automatically control each of said plurality of solid waste disposal systems at each location and can recognize a pattern of changed conditions in each of said plurality of solid waste disposal systems and modify the predetermined performance level of each solid waste disposal system by modifying the predetermined performance range of each of one or more of the subsystems associated with each of said plurality of solid waste disposal systems.

16. A method for controlling a solid waste disposal system having a solid waste combustion chamber and a plurality of subsystems, the method comprising the steps of:

setting a predetermined performance range for a plurality of measurable conditions throughout the solid waste disposal system;

feeding solid waste into the combustion chamber for incineration:

continuously sensing the measurable conditions throughout the solid waste disposal system;

transmitting the measured conditions to a controller;

storing the measured conditions in a memory;

automatically comparing with the controller each of the measured conditions to the associated predetermined performance range for the condition and automatically determining an action to modify the performance of one or more of the subsystems so as to operate the solid waste disposal system at a predetermined performance level;

generating a report with the controller on the performance of the solid waste disposal system for a period of time from the stored measured conditions; automatically modifying the predetermined performance range of one or more of the measurable conditions responsive to a pattern of change in the measurable conditions; and generating an alarm signal with alarm circuitry when said continuously sensing and automatically comparing steps determine that an alarm condition exists in the solid waste disposal system.

* * * * *